US008544664B2

(12) United States Patent
Dejonge

(10) Patent No.: US 8,544,664 B2
(45) Date of Patent: Oct. 1, 2013

(54) CHILD RESISTANT CONTAINER WITH INVERTING CAP BOTTOM LIFT

(76) Inventor: Stuart W. Dejonge, Deland, FL (US)

( * ) Notice: Subject to any disclaimer, the term of this patent is extended or adjusted under 35 U.S.C. 154(b) by 171 days.

(21) Appl. No.: 12/931,135

(22) Filed: Jan. 25, 2011

(65) Prior Publication Data

US 2012/0187070 A1 Jul. 26, 2012

(51) Int. Cl.
*B65D 55/02* (2006.01)

(52) U.S. Cl.
USPC ..... 215/219; 220/601; 220/23.86; 220/23.87; 220/212; 220/254.1; 222/182; 222/153.13

(58) Field of Classification Search
USPC ..... 220/601, 23.83, 23.86, 23.87, 23.89, 220/212, 254.1; 222/182, 153.13; 215/219, 215/201, 217
See application file for complete search history.

(56) References Cited

U.S. PATENT DOCUMENTS

| | | | | | |
|---|---|---|---|---|---|
| 3,831,804 | A | | 8/1974 | Focht | |
| 3,889,681 | A | * | 6/1975 | Waller et al. | 606/22 |
| 4,059,198 | A | * | 11/1977 | Mumford | 215/222 |
| 4,325,497 | A | | 4/1982 | Ewald | |
| 4,333,589 | A | | 6/1982 | Bush | |
| 4,337,869 | A | * | 7/1982 | Guinle | 215/201 |
| 4,555,035 | A | | 11/1985 | Davis | |
| 4,669,637 | A | * | 6/1987 | Fiocco | 222/187 |
| 4,854,459 | A | | 8/1989 | DeJonge | |
| 5,509,550 | A | | 4/1996 | DeJonge | |
| 5,564,580 | A | * | 10/1996 | Hamilton et al. | 215/209 |
| 5,732,836 | A | | 3/1998 | Barker | |
| 6,029,835 | A | | 2/2000 | DeJonge | |
| 6,032,811 | A | | 3/2000 | Marconi | |
| 6,880,729 | B2 | | 4/2005 | Stull | |
| 7,025,235 | B1 | * | 4/2006 | DeJonge | 222/548 |
| 7,832,577 | B2 | * | 11/2010 | Shingle et al. | 215/217 |
| 2006/0175226 | A1 | * | 8/2006 | Abergel | 206/568 |
| 2010/0038273 | A1 | * | 2/2010 | Johnson | 206/459.5 |
| 2012/0187151 | A1 | * | 7/2012 | DeJonge | 222/182 |

* cited by examiner

*Primary Examiner* — Mickey Yu
*Assistant Examiner* — Kareen Rush
(74) *Attorney, Agent, or Firm* — Kenneth P. Glynn, Esq.; Deirdra M. Meagher, Esq.

(57) ABSTRACT

A child resistant container with inverting cap bottom lift features has a container main body adapted to receive a sprayer container with a top-positioned spray activator, and has at least one lift rod slot on its bottom; an inner cap for permanent connection to the open top of the container after a spray container is placed therein; and an outer cap with at least one downwardly projecting lift rod. The inner cap has a spray activator orifice large enough to permit a spray activator of a spray container to pass therethrough and small enough to prevent a spray container connected to the spray activator from passing therethrough. A user removes the outer cap, inverts it and pushes up through the bottom to raise up the spray container enough to expose the spray activator and its nozzle for spray use.

20 Claims, 10 Drawing Sheets

CHILD RESISTANT CONTAINER WITH INVERTING CAP BOTTOM LIFT

BACKGROUND OF INVENTION a. Field of Invention

The field of the invention is child resistant containers with safety caps developed to inhibit dispensing of potentially harmful or restricted contents by children. The invention relates generally to a child resistant container that is adapted to receive and to lock in a sprayer container with a top-positioned spay activator. The device has a container body, an inner cap and an outer cap. The outer cap may be removed and inverted and then used to push up a spray container for user spray activation. The device is particularly beneficial as a retrofit child resistant container for potentially dangerous spray products to children; e.g., medicines, oven cleaners, etc.

b. Description of Related Art

The following patents are representative of the field pertaining to the present invention:

U.S. Pat. No. 6,880,729 B2 to Gene Stull et al describes a secure lock for container packaging with a flexible retaining lip of various formations for sealing against material product flow distributions with the secure seal preventing tampering of, for example, a flexible walled container of material such as a medication, food stuff or art material. A resistant secure lock is provided which in one embodiment meets Federal Child Safety Standards providing a seal of flexible locking and unlocking which is resistant to a child's tampering. In one embodiment, a tamper resistant seal is formed for a squeezable container cap with a flexible hinging structure connecting a cap to a cap receptor base structure of a container to prevent a material product such as medicine from dispensing without disengaging the seal selectively to allow access to an aperture, yet with a directed flexion of a lip or head, the seal simply unsnaps from a tamper resistant state to release the flow of product through an aperture from a container.

U.S. Pat. No. 6,032,811 to Anthony Marconi describes a child resistant cap assembly that includes an outer cap member having a top wall and a substantially cylindrical side wall depending therefrom. On the exterior surface of the top wall is a key slot and an alignment aperture. An inner cap member for threadedly engaging a container neck is concentrically received within said outer cap member has a mark and key slot on its top wall. The outer cap member normally rotates independently of the inner cap member. When the outer cap member's alignment aperture registers with the mark on the inner cap member, the key slots are aligned allowing a key member to be inserted therethrough. Accordingly, the inserted key member is then rotated to simultaneously rotate the inner and outer cap. The top wall of the outer cap member also includes means for removably retaining the key thereon.

U.S. Pat. No. 6,029,835 to Stuart DeJonge describes a child resistant safety cap for containers that includes an outer cap, an inner cap, at least one retractable-extendable key arm and a biasing spring. The outer cap has a top and a sidewall with a plurality of openings for retraction and extension of the key arms therethrough, and the top has an engaging mechanism for engaging and disengaging the key arms. The inner cap is contained within the outer cap, has a sidewall and a top, with a slide mechanism for slideably attaching a plurality key of arms. The inner cap is a predetermined height less than the inside vertically slidable within the outer cap. The inner cap has a first vertical position away from the top of the outer cap wherein said engaging mechanism of the outer cap and the connecting mechanism of the plurality of key arms are disengaged, and the inner cap has a second vertical position, toward the top of the outer cap wherein the engaging mechanism and the connecting mechanism are engaged. The inner cap also has threading on its inside for screwing onto and off a threaded container.

U.S. Pat. No. 5,732,836 to Allan Barker et al. describes a closure for a container, including means for counting and indicating the number of times the closure has undergone a cycle of closing and opening the container, and further including means for incorporating the closure into means for resisting the opening of the container by a child. In a preferred embodiment, the closure includes an outer cover having an indicator symbol window an indicator symbol carrier rotatably mounted in the outer cover with indicator symbols visible through the indicator window, tooth and pawl means for allowing one-way rotation of the outer cover relative to the indicator symbol carrier to allow the advancement of the window and an audible click as the pawl passes over a tooth to confirm proper advancement, lost motion means for positively assuring the advancement of the window by one and only one indicator symbol upon each cycle, and a closure mechanism requiring the application of an axial force urging the closure toward the container while applying a rotational force to disengage the closure from the container.

U.S. Pat. No. 5,509,550 to Stuart DeJonge describes the child resistant cap device for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key which is pivotable for 180° rotation so as to be engageable with the key arrangement of the inner cap so as to permit opening of the inner cap by rotation of the outer cap when the release key is engaged in the release key engagement.

U.S. Pat. No. 4,854,459 to Antonia DeJonge describes the present invention involves a container and cap which is generally childproof and may be rendered non-childproof permanently. The invention involves a container having a cylindrical neck at the top and threads molded about the exterior of the neck as well as an inner cap and outer cap. The inner cap has a top and a cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two ratchet type segments and thereby engage the two caps to permit opening. Further, the outer cap has an opening in its side wall at a lever near the bottom of the side wall of the inner cap and also has integrally attached thereto a flexible connector and stop. The flexible connector and stop are located so as to permit insertion of the stop into the opening so as to extend beyond the opening and push up the inner cap so as to permanently lock it into a position wherein the inner cap and outer cap ratchet type segments are permanently engaged. This renders the cap permanently non-childproof.

U.S. Pat. No. 4,555,035 to Eugene Davis describes a closure for a container. The closure is provided with a tunnel member into which any appropriate implement such as the handle of a teaspoon can be inserted when it is desired to manipulate the closure e.g. for opening. The provision of the tunnel member is of great assistance to people lacking in manual dexterity.

U.S. Pat. No. 4,333,589 to Randall Bush describes a child-resistant overcap for a pressurized container, such as an aerosol can, having a valve with an axially protruding discharge nozzle which must be depressed to actuate the valve for discharging the contents of the container. The overcap includes a valve guard moveable between an outer position in which a portion of the guard overlies the nozzle for preventing actuation thereof and an inner position in which the nozzle can be depressed. The overcap includes a resilient portion of the guard which biases the guard toward outer position and which must be overcome in order to move the guard to inner position and which returns the guard to outer position when the guard is released.

U.S. Pat. No. 4,325,497 to Ronald Ewald describes a child resistant spray through cover assembly for aerosol and similar containers. The cover assembly is adapted to be applied to a container having a conventional actuator button with a discharge outlet in which the actuator button discharges when it is moved axially toward the container. The cover assembly includes a housing which is adapted to fit over the actuator button and to be securely attached to the container. An opening is formed in the housing to allow the passage of spray discharge through the discharge outlet of the actuator button. A moveable flap is mounted on the housing and extends over the actuator button. The flap is moveable upon the application of force thereto by a finger of a user between a first position in which it is located out of actuating engagement with the actuator button and a second position in which it is in actuating engagement with the actuator button. A locking mechanism is provided to retain the flap in its first position. A finger engaging mechanism is provided for releasing the locking mechanism to permit the flap to be moved to its second position. A mechanism is provided on the flap for depressing the actuator button when the flap is moved to its second position. A spring arrangement is provided to return the flap to its first position and the locking mechanism to locking engagement with the flap when the application of force to the flap is discontinued so that the child resistant features of the cover assembly are automatically restored after the use and without any active participation of the user.

U.S. Pat. No. 3,831,804 to John Richard Focht describes an aerosol safety cap for an aerosol container including inner and outer telescoping members. The outer member includes dependant resilient locking means which snap under the interior of the annular bead of the mounting cup of the aerosol container to affix the outer member to the container. When the inner member is telescoped into the outer member, it prevents the resilient locking means from being inwardly deflected thereby preventing removal of the cap assembly from the container. Withdrawal of the inner telescopic member permits deflection of the depending locking means to permit removal of the cap from the container. The inner membrane cannot be withdrawn without the aid of a prying instrument such as a coin. The cap can be doubly locked by rotating the inner member with respect to the outer member with an instrument such as a coin into a position in which it can be pried upwardly.

Notwithstanding the prior art, the present invention is neither taught nor rendered obvious thereby.

SUMMARY OF INVENTION

The present invention relates to a child resistant container with inverting cap bottom lift. It includes: (a) a container main body having an open top, a sidewall, and a bottom, said bottom having at least one lift rod slot, said container main body adapted to receive a sprayer container with a top-positioned spray activator, said container main body having a first locking member for receiving and locking an inner cap thereto; (b) an inner cap adapted for permanent connection to said open top of said container main body and having a second locking member to coincide and lock with said first locking member, said inner cap having a spray activator orifice large enough to permit a spray activator of a spray container to pass therethrough and small enough to prevent a spray container connected to said spray activator from passing therethrough; (c) an outer cap adapted to fit over said inner cap and onto at least one of said inner cap and said container main body, said outer cap having a closed top, a sidewall and at least one downwardly projecting lift rod; wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the bottom of said container main body and align the at least one lift rod with said container main body at least one lift rod slot, and push up said outer cap to cause said at least one lift rod to push said spray container up and to thereby push said spray activator up to expose it for spraying contents of said spray container.

In some embodiments of the present invention child resistant container with inverting cap bottom lift, the container main body, said inner cap and said outer cap have circular top view footprints.

In some embodiments of the present invention child resistant container with inverting cap bottom lift, the first locking member and said second locking member are coinciding components of a force-fit locking protrusion and recess.

In some embodiments of the present invention child resistant container with inverting cap bottom lift, the outer cap of extends downwardly over said container main body and is friction fitting to said container main body.

In some embodiments of the present invention child resistant container with inverting cap bottom lift, the inner cap spray activator orifice includes open area adapted to receive said at least one downwardly projecting lift rod of said outer cap, and said at least one downward projecting lift rod extends through said inner cap spray activator orifice when said outer cap is attached to at least one of said cap and said container main body.

In some embodiments of the present invention child resistant container with inverting cap bottom lift, there are at least two downwardly projecting lift rods was on said outer cap and there are an equal number of corresponding lift rod slots on said bottom of said container main body.

In some preferred embodiments of the present invention child resistant container with inverting cap bottom lift, the present invention child resistant container with inverting cap bottom lift includes: (a) a container main body having an open top, a sidewall, and a bottom, said bottom having at least one lift rod slot, said container main body adapted to receive a sprayer container with a top-positioned spray activator, said container main body having a first locking member for receiving and locking an inner cap thereto, said container main body having at least one vertical guide track on its sidewall, said vertical guide track being selected from one of the group consisting of a recessed track and a raised track; (b) an inner cap adapted for permanent connection to said open top of said container main body and having a second locking member to coincide and lock with said first locking member, said inner cap having a spray activator orifice large enough to permit a spray activator of a spray container to pass therethrough and small enough to prevent a spray container connected to said spray activator from passing therethrough; (c) an outer cap adapted to fit over said inner cap and onto at least one of said inner cap and said container main body, said outer cap having a closed top, a sidewall and at least one downwardly projecting lift rod, said container main body having a first locking member for receiving and locking an inner cap thereto, said outer cap having at least one vertical guide track on its sidewall, said vertical guide track being selected from one of the group consisting of a recessed track and a raised track and corresponding to and interfitting with said container main body at least one vertical guide track; wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the bottom of said container main body and align it with its vertical guide track interfitting with said container main body vertical guide track to align the at least one lift rod with said container main body at least one lift rod slot, and push up said outer cap to cause said at least one lift rod to push said spray container up and to thereby push said spray activator up to expose it for spraying contents of said spray container. In this preferred embodiment, each of the additional features described in the preceding paragraphs may be included in conjunction therewith.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
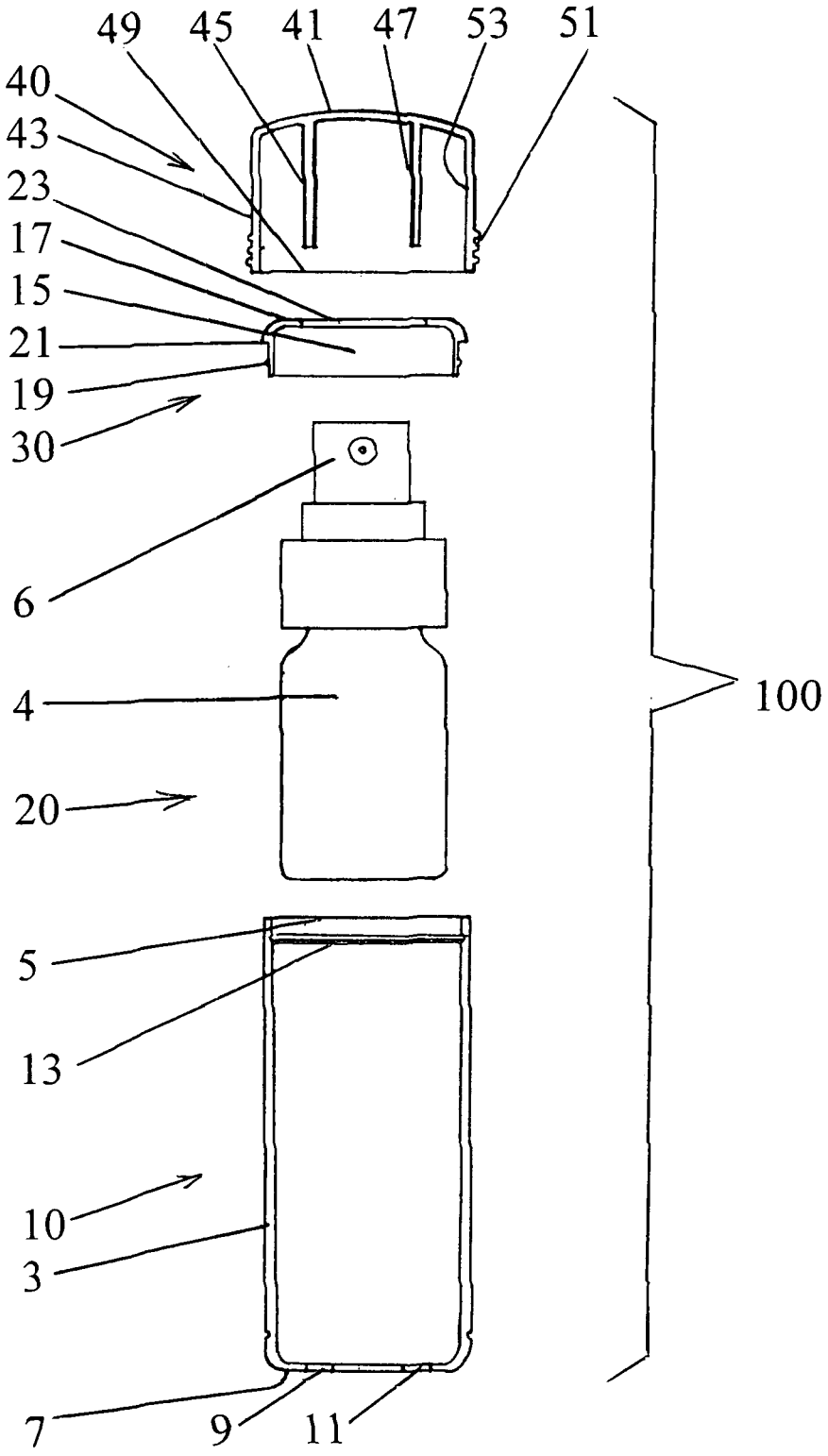
FIG. 1 shows an exploded cut front view of a present invention child resistant container with inverting cap bottom lift features and also shows an uncut front view of a sprayer container with a top-mounted spray activator and nozzle.

The invention relates generally to a child resistant container that is adapted to receive and to lock in a sprayer container with a top-positioned spray activator. The device is particularly beneficial as a retrofit child resistant container for potentially dangerous spray products to children, e.g., medicines, oven cleaners, etc. The device has a container main body for receiving the sprayer container, an inner cap to lock in the spray container and to allow the spray activator of the spray container to rise up and down. In the up position, the spray activator may be used to activate a spray, and in the down position, the spray activator cannot be activated successfully. The inner cap thus has a top orifice that lets the spray activator be moved up and down through it, yet its opening is small enough to inhibit removal of the spray container itself. An outer cap acts as an overcap and can be removed and inverted to expose lift rod(s). The lift rod(s) are fitted upwardly on the underside of the container main body bottom in the lift rod slots that geometrically correspond to and receive the lift rod(s). When the outer cap is thus inverted and bottom inserted, it is merely pushed upwardly to expose the spray activator for use.

Referring now to the drawings wherein like reference numerals designate corresponding parts throughout the several views, the present invention is exemplified as follows:

FIG. 1 shows an exploded cut front view of a present invention child resistant container with inverting cap bottom lift features and also shows an uncut front view of a sprayer container with a top-mounted spray activator and nozzle. These are collectively shown as loaded present invention device 100*a*. The present invention child resistant container includes a container main body 10, an inner cap 30 and an outer cap 40. The container main body 10 has an open top 5, a circular sidewall 3 and a bottom 7. Although sidewall 3 has a circular top view footprint, it could take any shape that would receive a spray container. Further, it need not have the same footprint shape as a spray container. For example, a circular spray container would readily fit into a hexagonal or octagonal container main body.

Figure 2:
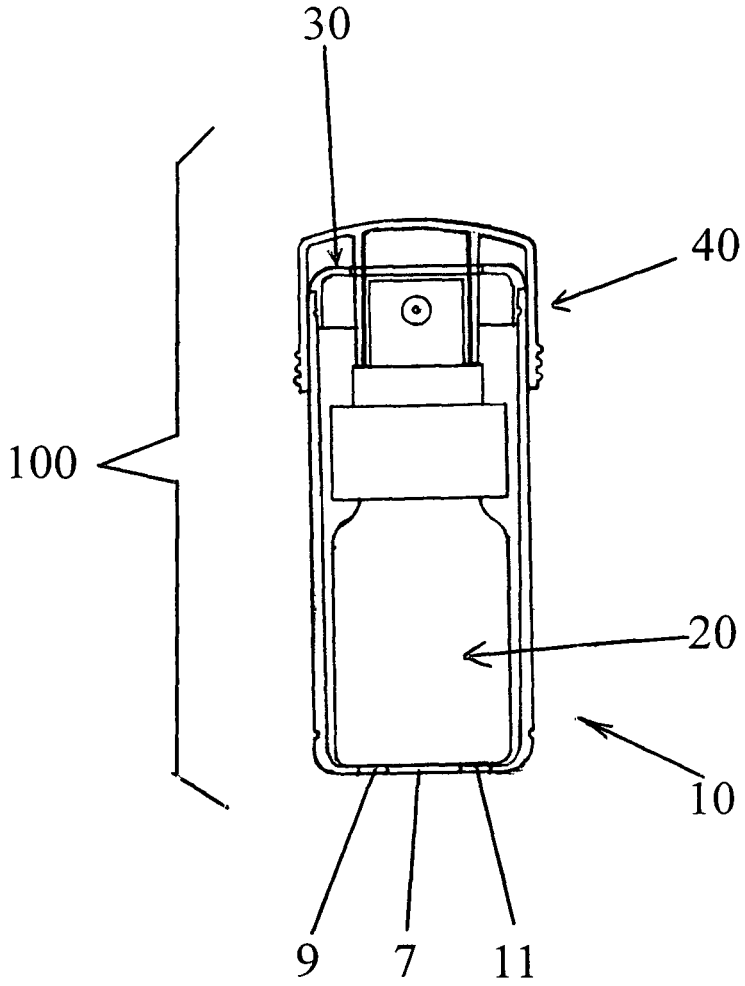
FIG. 2 illustrates a cut front view of the present invention and the spray container shown in FIG. 1 fully assembled.

Container main body 10, in this example, has two symmetrical lift rod slots 9 and 11. These are to receive lift rods from outer cap 40, as more fully described below. Although this FIG. 1 shows an exploded view, FIG. 2 illustrates a fully assembled view of the same elements. Thus, in FIG. 2, the loaded device is collectively shown as present invention device 100*b*. The following and foregoing discussion is in reference to both FIG. 1 and FIG. 2.

Spray container 20 has sidewall 4 and a top-positioned spray activator 6. Preferably, container main body 10 is designed to receive spray container 20 with slight friction to prevent rattling. On the inside of sidewall 3 of container main body 10, near the open top 5, is a first locking member 13 for receiving and locking inner cap 30 thereto. Thus, spray container 20 is inserted into container main body 10 and then inner cap 30 is permanently attached to open top 5.

Inner cap 30 has a sidewall 15 and a top 17 with spray activator orifice 23. Inner cap 30 also has a ledge 21 and a second locking member 19. When inner cap 30 is pushed into container main body 10, the male locking track, also known as second locking member 19, snaps into female receiving first locking member 13 of container main body 10 with ledge 21 fitting atop sidewall 3. Orifice 23 is large enough in its opening to permit spray activator 6 of spray container 20 to pass therethrough, but small enough to prohibit spray container 20 from passing therethrough. As can be seen in both Figures, spray activators are narrower than the main bodies of spray containers, enabling spray activator orifice 23 to function as described above, i.e., allowing the spray activator to pass therethrough but otherwise restraining the spray container 20 within the container main body and inner cap 30.

Outer cap 40 has a top 41 and a sidewall 43, as shown. Outer cap 40 has an open bottom 49. The inside 53 of sidewall 43 of outer cap 40 is, in this embodiment, adapted to fit over inner cap 30 and to snuggly fit onto container main body 10. Extending downwardly from the inside of top 41 of outer cap 40 are two push rods 45 and 47. These have the same footprint and are positioned to fit into push rod slots 9 and 11 when outer cap 40 is inverted and positioned as discussed below. Also, push rods 45 and 47 are of sufficient length such that when they are inserted into push rod slots 9 and 11, they will lift up spray container 20 to expose spray activator 6 for use. As mentioned above, FIG. 1 is an exploded partially cut view and FIG. 2 shows the same partially cut elements fully assembled.

Figure 3:
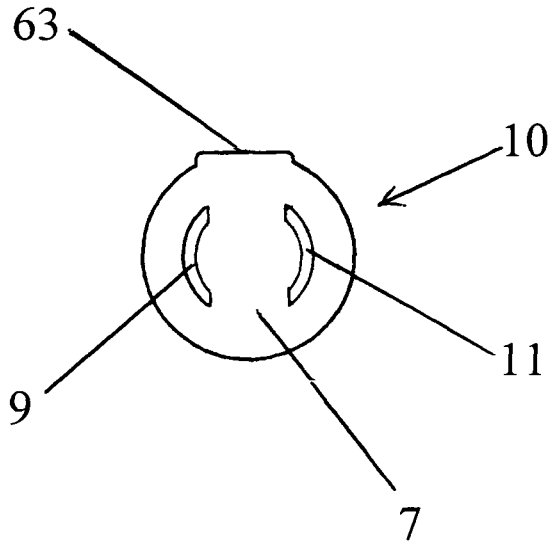
FIG. 3 shows a bottom view.
Figure 4:
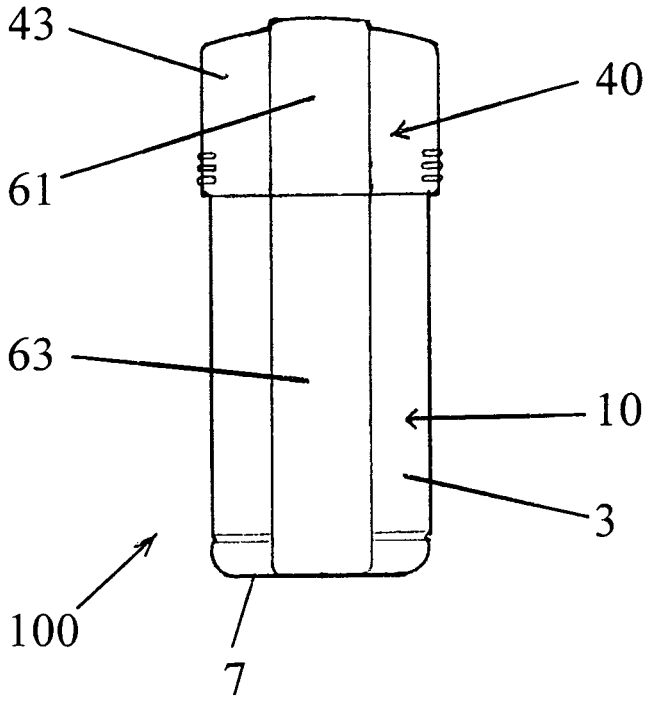
FIG. 4 shows a front view.
Figure 5:
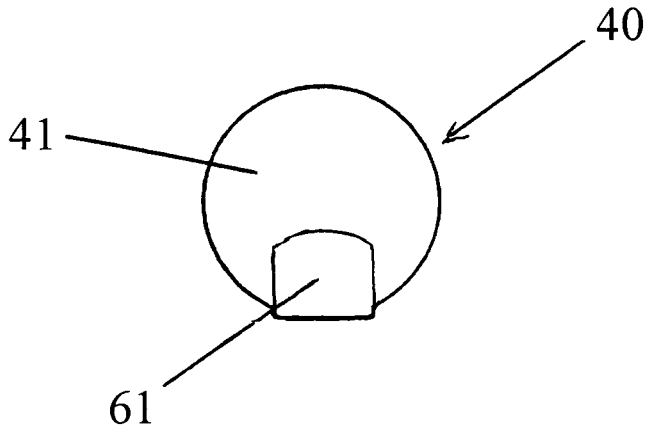
FIG. 5 shows a top view of the preferred present invention device illustrated in the preceding figures.

FIG. 3 shows a bottom view, FIG. 4 shows a front view and FIG. 5 shows a top view of the preferred present invention device illustrated in the preceding figures. Identical parts in these figures are identically numbered as presented in the previous drawings. These are also true of the subsequent Figures below and, hence, are not necessarily repeated further herein. FIGS. 4 and 5 show a vertical guide track that extends vertically as first track 63 on container main body 10 and as second track 61 on outer cap 40. It is not shown, but on container main body 10 track 63 extends vertically upwardly to the top of container main body 10 so that it partially nests under track 61.

Figure 6:
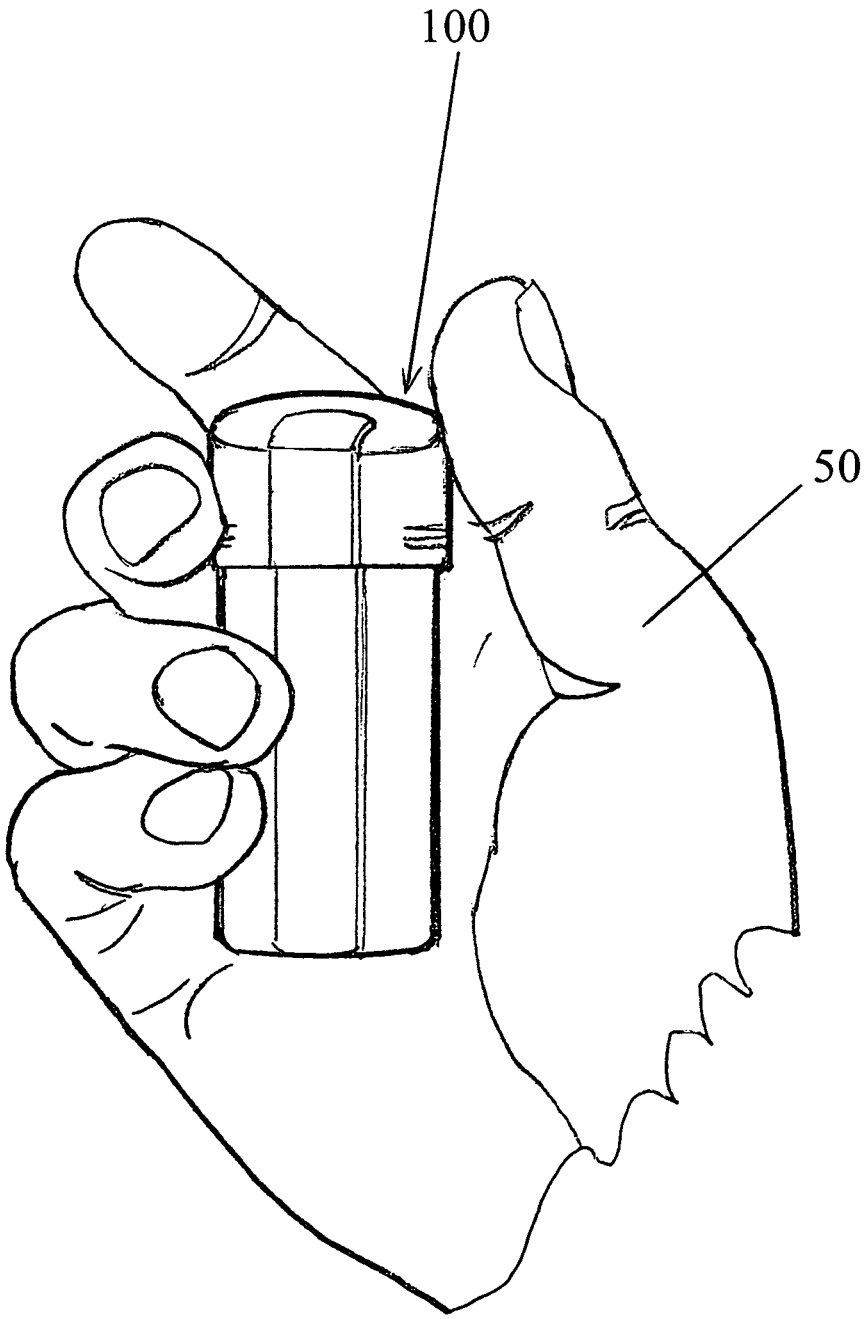
FIG. 6 shows a person's right hand holding a present invention device as illustrated above.

FIG. 6 shows a person's right hand 50 holding a present invention device as illustrated above. As can be seen, the present invention device 100 is easily hand held, self-sufficient and extremely portable.

Figure 7:
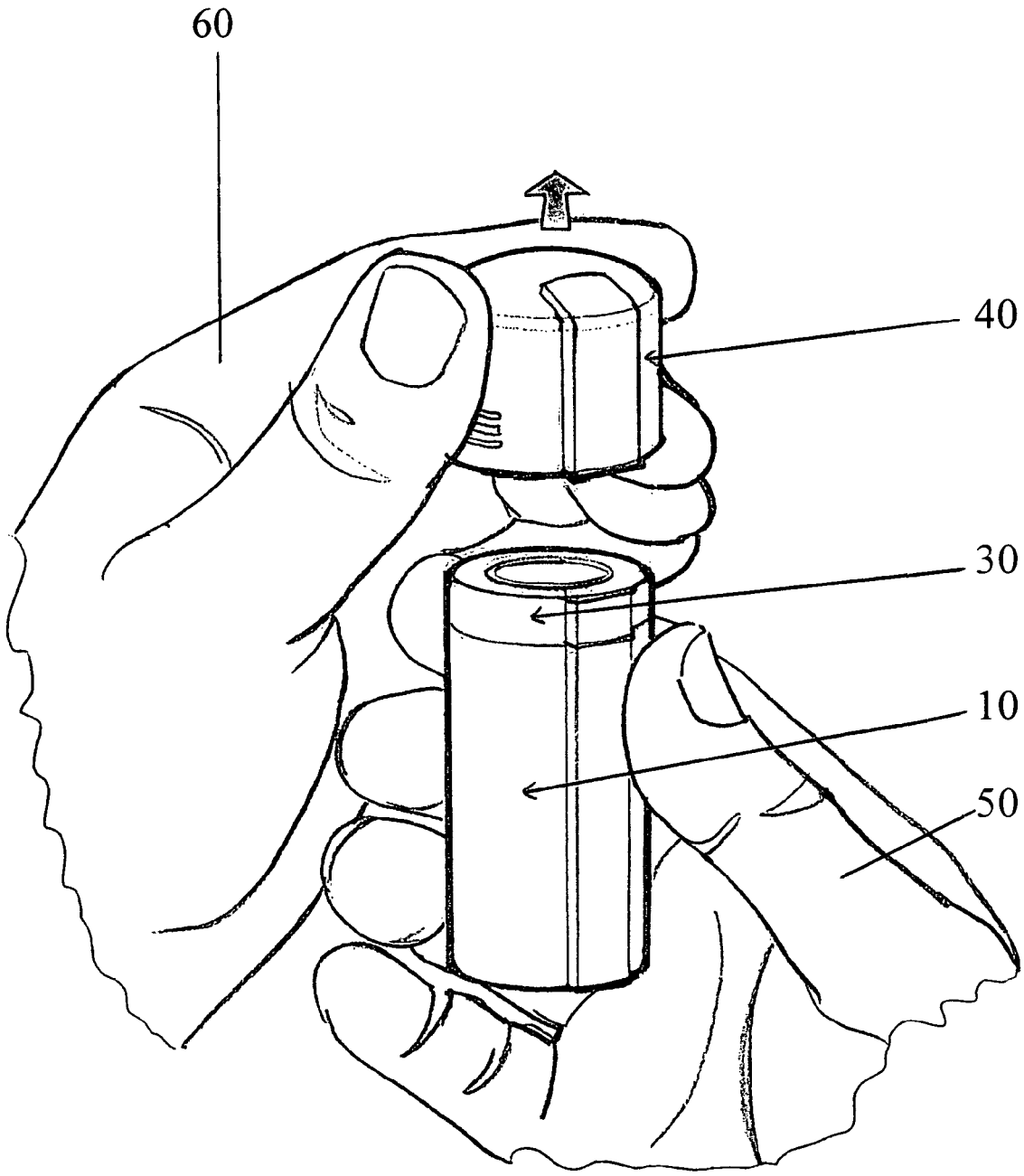
FIG. 7 shows a present invention device of FIG. 6 with two hands, one holding the present invention container main body and one removing the outer cap therefrom.

FIG. 7 shows a present invention device 100 of FIG. 6 with two hands 50 and 60, one holding the present invention container main body 10 and one removing the outer cap 40 therefrom.

Figure 8:
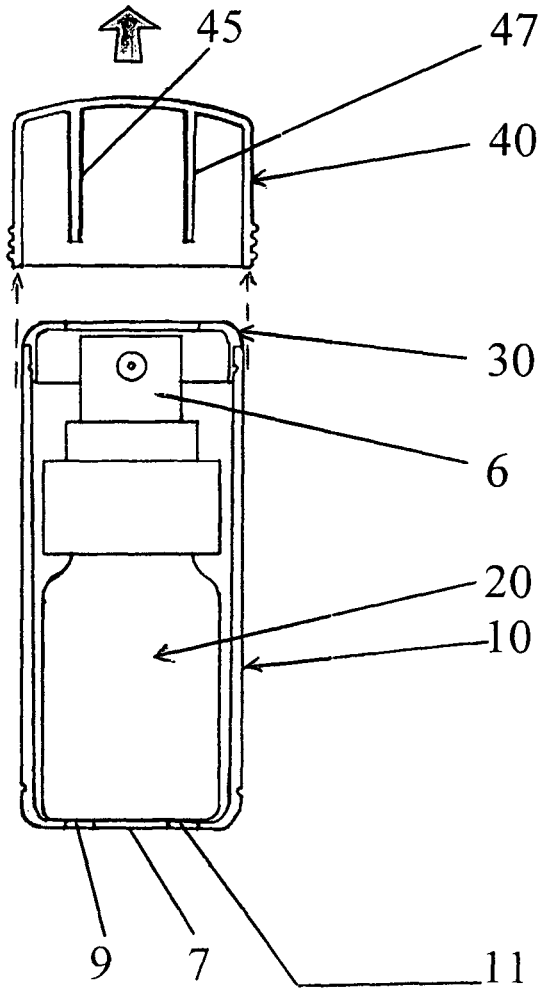
FIG. 8 shows a cut view of the present invention devices it appears in FIG. 7.

FIG. 8 shows a cut view of the present invention device 100 it appears in FIG. 7.

Figure 9:
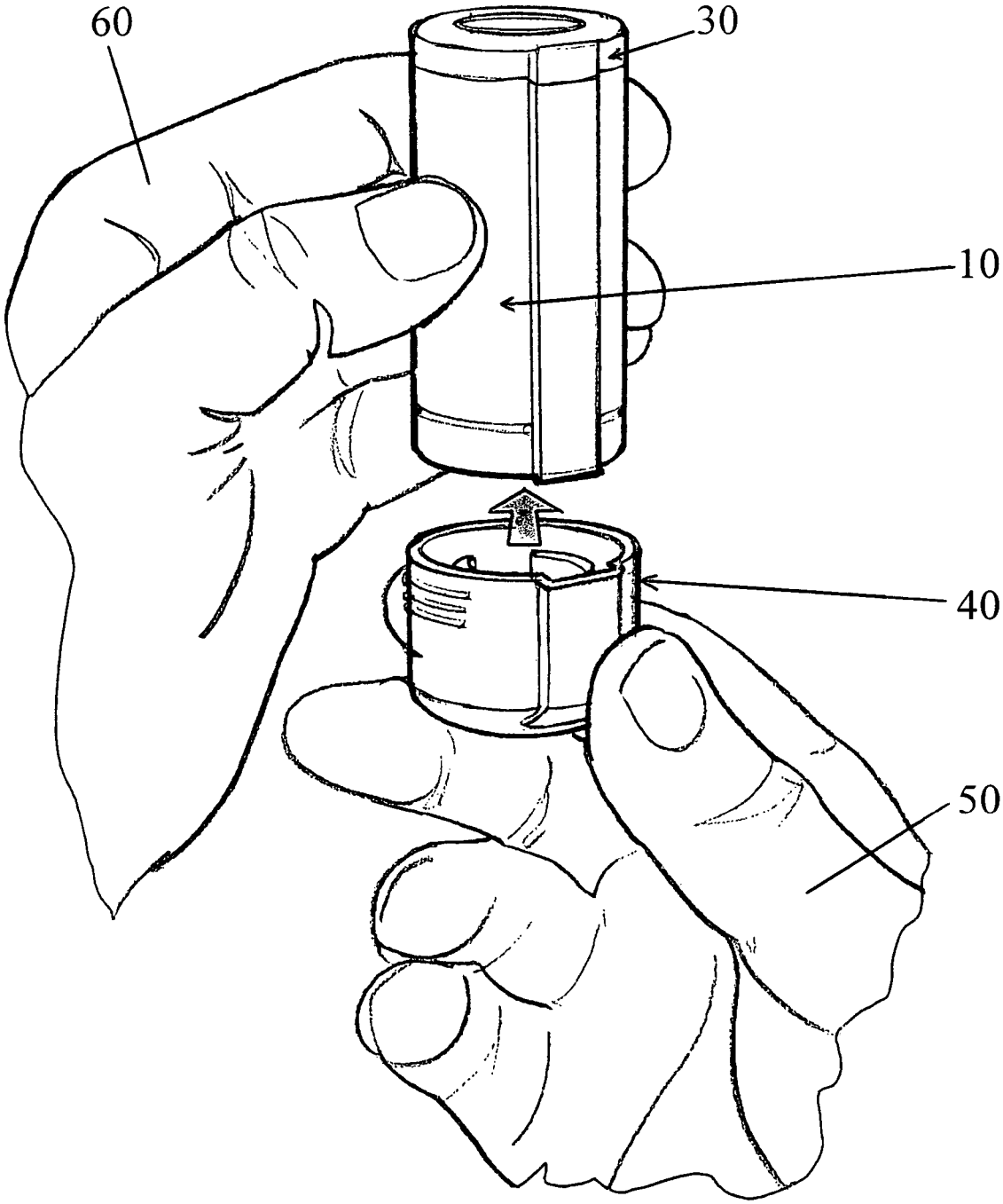
FIG. 9 shows the present invention device of FIGS. 7 and 8 but with the removed outer cap now inverted and moving toward the underside of the container main body for subsequent push up of the spray container.

FIG. 9 shows the present invention device 100 of FIGS. 7 and 8 but with the removed outer cap 40 now inverted and moving toward the underside (bottom 7) of the container main body 10 for subsequent push up of the spray container 20.

Figure 10:
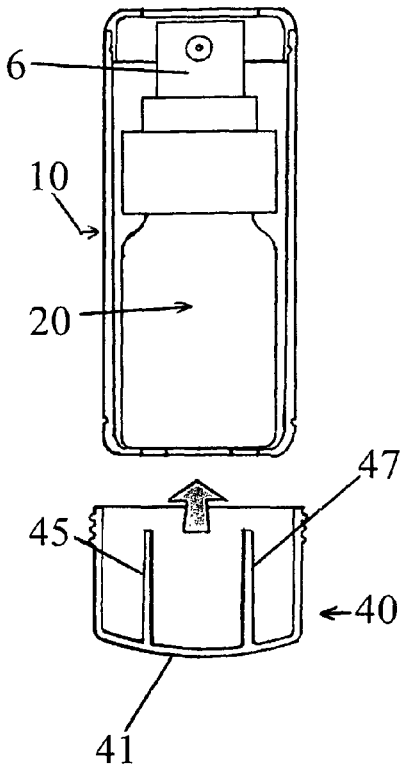
FIG. 10 shows a cut view of the present invention device as it appears in FIG. 9.

FIG. 10 shows a cut view of the present invention device 100 as it appears in FIG. 9.

Figure 11:
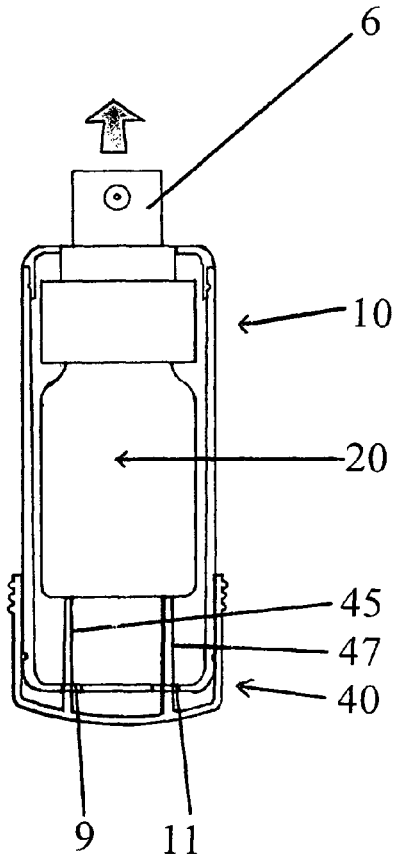
FIG. 11 shows a cut view of the present invention device illustrated above, but fully pushed up so as to lift the spray container to expose the spray activator for use.

FIG. 11 shows a cut view of the present invention device illustrated above, but fully pushed up with the push rods 45 and 47 significantly into push rod slots 7 and 9, as shown, so as to lift the spray container 20 to expose the spray activator 6 for use.

Figure 12:
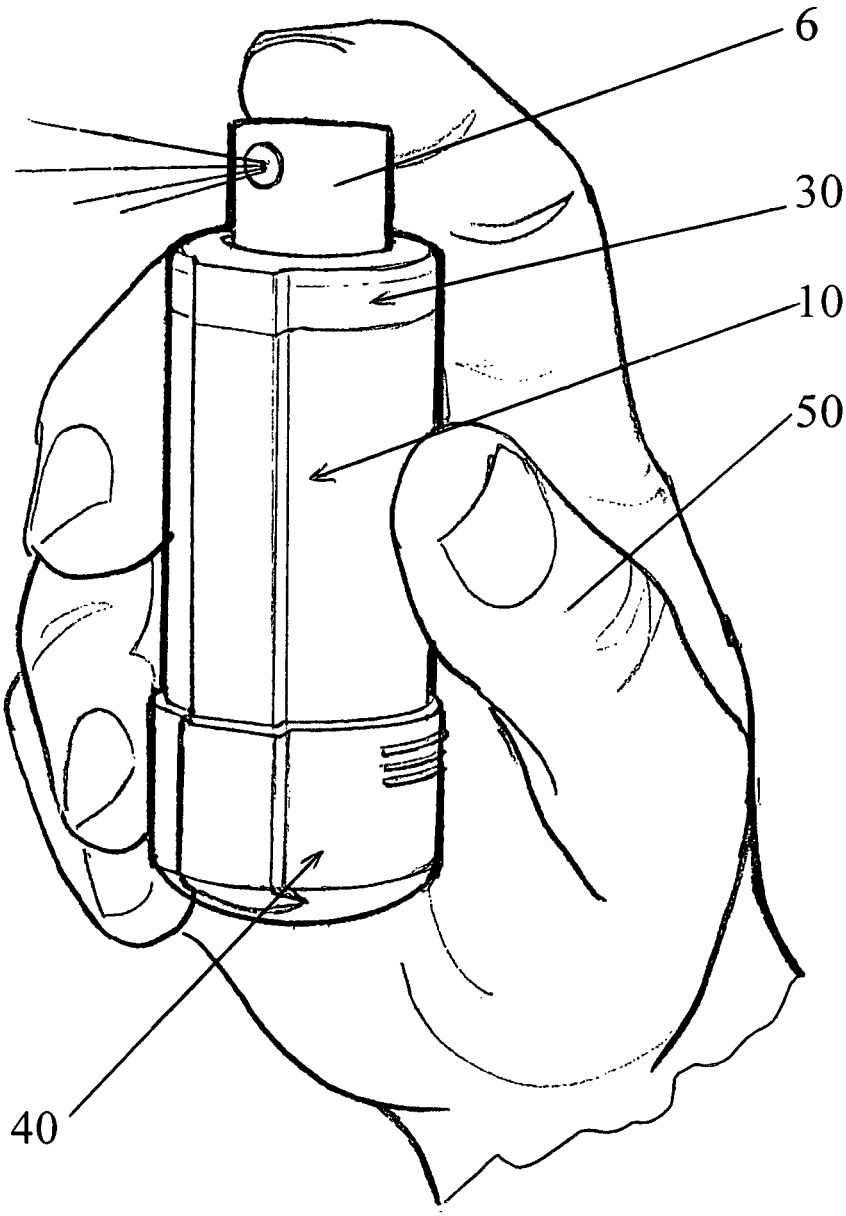
FIG. 12 shows a person's hand using the present invention device as shown in FIG. 11, but with the spray activator being depressed and spraying.

FIG. 12 shows a person's hand 50 using the present invention device 100 as shown in FIG. 11, but with the spray activator 6 being depressed and spraying.

Figure 13:
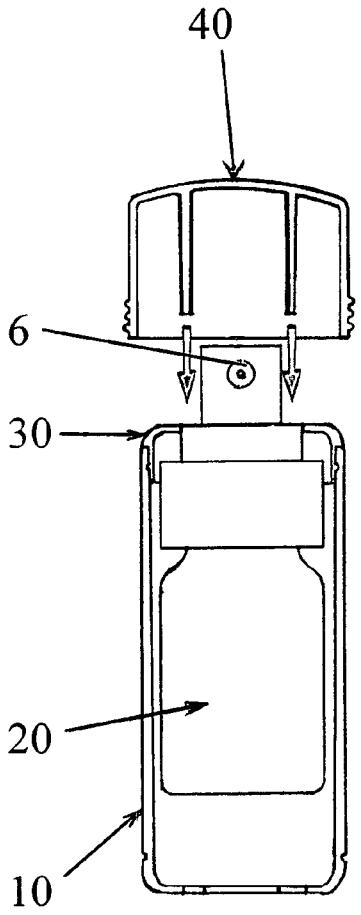
FIG. 13 shows a front cut view of the present invention device illustrated above, typically after use, with the outer cap being placed again on the top; and, FIG. 14 shows the fully closed, child resistant present invention device after use.

FIG. 13 shows a front cut view of the present invention device 100 illustrated above, typically after use, with the outer cap 40 being placed again on the top 5 of container main body 10.

Figure 14:
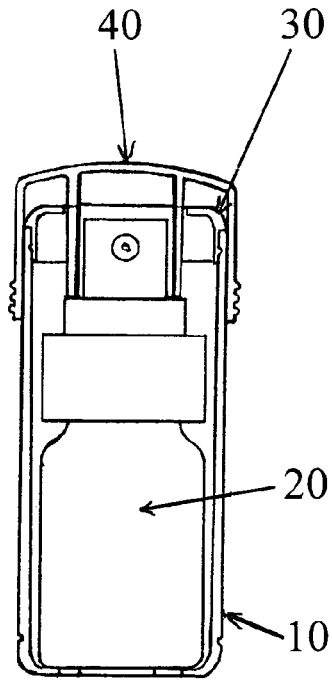

FIG. 14 shows the fully closed, child resistant present invention device 100 after use. As intimated by the Figures, once a user has completed a spray application from the spray container, the user removes the outer cap 40 from the bottom of the container main body 10, inverts it, and then recaps the device to the original, closed, child resistant state, as shown in FIG. 14.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A child resistant container with inverting cap bottom lift which comprises:

(a) a container main body having an open top, a sidewall, and a bottom, said bottom having at least one lift rod slot, said container main body adapted to receive a sprayer container with a top-positioned spray activator, said container main body having a first locking member for receiving and locking an inner cap thereto;

(b) an inner cap adapted for permanent connection to said open top of said container main body and having a second locking member to coincide and lock with said first locking member, said inner cap having a spray activator orifice large enough to permit a spray activator of a spray container to pass therethrough and small enough to prevent a spray container connected to said spray activator from passing therethrough;

(c) an outer cap adapted to fit over said inner cap and onto at least one of said inner cap and said container main body, said outer cap having a closed top, a sidewall and at least one downwardly projecting lift rod;

wherein when a user inserts a sprayer container into said container main body, permanently attaches said inner cap to said container main body, and covers said inner cap with said outer cap and onto at least one of said inner cap and said container main body for storage and safekeeping, said container is child resistant, and, wherein when a user subsequently removes said outer cap, inverts it, places it on the bottom of said container main body and aligns the at least one lift rod with said container main body at least one lift rod slot, and then pushes up said outer cap, it causes said at least one lift rod to push said spray container up and to thereby push said spray activator up to expose it for subsequent spraying of contents of said spray container.

2. The child resistant container with inverting cap bottom lift of claim 1 wherein said container main body, said inner cap and said outer cap have circular top view footprints.

3. The child resistant container with inverting cap bottom lift of claim 1 wherein said first locking member and said second locking member are coinciding components of a force-fit locking protrusion and recess.

4. The child resistant container with inverting cap bottom lift of claim 1 wherein said outer cap of extends downwardly over said container main body and is friction fitting to said container main body.

5. The child resistant container with inverting cap bottom lift of claim 1 wherein said inner cap spray activator orifice includes open area adapted to receive said at least one downwardly projecting lift rod of said outer cap, and said at least one downward projecting lift rod extends through said inner cap spray activator orifice when said outer cap is attached to at least one of said cap and said container main body.

6. The child resistant container with inverting cap bottom lift in claim 1 wherein there are at least two downwardly projecting lift rods was on said outer cap and there are an equal number of corresponding lift rod slots on said bottom of said container main body.

7. The child resistant container with inverting cap bottom lift of claim 6 wherein said container main body, said inner cap and said outer cap have circular top view footprints.

8. The child resistant container with inverting cap bottom lift of claim 6 wherein said first locking member and said second locking member are coinciding components of a force-fit locking protrusion and recess.

9. The child resistant container with inverting cap bottom lift of claim 6 wherein said outer cap of extends downwardly over said container main body and is friction fitting to said container main body.

10. The child resistant container with inverting cap bottom lift of claim 6 wherein said inner cap spray activator orifice includes open area adapted to receive said at least two downwardly projecting lift rods of said outer cap, and said at least two downward projecting lift rods extend through said inner cap spray activator orifice when said outer cap is attached to at least one of said cap and said container main body.

11. A child resistant container with inverting cap bottom lift which comprises:

(a) a container main body having an open top, a sidewall, and a bottom, said bottom having at least one lift rod slot, said container main body adapted to receive a sprayer container with a top-positioned spray activator, said container main body having a first locking member for receiving and locking an inner cap thereto, said container main body having at least one vertical guide track on its sidewall, said vertical guide track being selected from one of the group consisting of a recessed track and a raised track;

(b) an inner cap adapted for permanent connection to said open top of said container main body and having a second locking member to coincide and lock with said first locking member, said inner cap having a spray activator orifice large enough to permit a spray activator of a spray container to pass therethrough and small enough to prevent a spray container connected to said spray activator from passing therethrough;

(c) an outer cap adapted to fit over said inner cap and onto at least one of said inner cap and said container main body, said outer cap having a closed top, a sidewall and at least one downwardly projecting lift rod, said container main body having a first locking member for receiving and locking an inner cap thereto, said outer cap having at least one vertical guide track on its sidewall, said vertical guide track being selected from one of the group consisting of a recessed track and a raised track and corresponding to and interfitting with said container main body at least one vertical guide track;

wherein when a user inserts a sprayer container into said container main body, permanently attaches said inner cap to said container main body, and covers said inner cap with said outer cap and onto at least one of said inner cap and said container main body for storage and safekeeping, said container is child resistant, and, wherein when a user subsequently removes said outer cap, inverts it, places it on the bottom of said container main body and aligns it with its vertical guide track interfitting with said container main body vertical guide track to align the at least one lift rod with said container main body at least one lift rod slot, and then pushes up said outer cap, it causes said at least one lift rod to push said spray container up and to thereby push said spray activator up to expose it for subsequent spraying of contents of said spray container.

12. The child resistant container with inverting cap bottom lift of claim 11 wherein said container main body, said inner cap and said outer cap have circular top view footprints.

13. The child resistant container with inverting cap bottom lift of claim 11 wherein said first locking member and said second locking member are coinciding components of a force-fit locking protrusion and recess.

14. The child resistant container with inverting cap bottom lift of claim 11 wherein said outer cap of extends downwardly over said container main body and is friction fitting to said container main body.

15. The child resistant container with inverting cap bottom lift of claim 11 wherein said inner cap spray activator orifice includes open area adapted to receive said at least one downwardly projecting lift rod of said outer cap, and said at least one downward projecting lift rod extends through said inner cap spray activator orifice when said outer cap is attached to at least one of said cap and said container main body.

16. The child resistant container with inverting cap bottom lift in claim 11 wherein there are at least two downwardly projecting lift rods was on said outer cap and there are an equal number of corresponding lift rod slots on said bottom of said container main body.

17. The child resistant container with inverting cap bottom lift of claim 16 wherein said container main body, said inner cap and said outer cap have circular top view footprints.

18. The child resistant container with inverting cap bottom lift of claim 16 wherein said first locking member and said second locking member are coinciding components of a force-fit locking protrusion and recess.

19. The child resistant container with inverting cap bottom lift of claim 16 wherein said outer cap of extends downwardly over said container main body and is friction fitting to said container main body.

20. The child resistant container with inverting cap bottom lift of claim 16 wherein said inner cap spray activator orifice includes open area adapted to receive said at least two downwardly projecting lift rods of said outer cap, and said at least two downward projecting lift rods extend through said inner cap spray activator orifice when said outer cap is attached to at least one of said cap and said container main body.

* * * * *